US008096760B2

(12) United States Patent
Kuma

(10) Patent No.: US 8,096,760 B2
(45) Date of Patent: Jan. 17, 2012

(54) CENTRIFUGAL AIR BLOWER

(75) Inventor: Hirofumi Kuma, Tochigi-Ken (JP)

(73) Assignee: Keihin Corporation, Tokyo (JP)

( * ) Notice: Subject to any disclaimer, the term of this patent is extended or adjusted under 35 U.S.C. 154(b) by 881 days.

(21) Appl. No.: 12/142,269

(22) Filed: Jun. 19, 2008

(65) Prior Publication Data

US 2008/0317586 A1 Dec. 25, 2008

(30) Foreign Application Priority Data

Jun. 20, 2007 (JP) ..... 2007-163001

(51) Int. Cl.
*F03B 11/02* (2006.01)

(52) U.S. Cl. ..... 415/208.2; 415/211.2

(58) Field of Classification Search ..... 415/208.2, 415/211.2

See application file for complete search history.

(56) References Cited

U.S. PATENT DOCUMENTS 6,695,580 B2 * 2/2004 Finkenbinder ..... 415/208.3
7,108,482 B2 * 9/2006 Chapman ..... 416/185
2002/0159881 A1 * 10/2002 Marshall et al. ..... 415/102
2002/0159887 A1 * 10/2002 Finkenbinder ..... 415/211.2
2005/0163614 A1 * 7/2005 Chapman ..... 415/206
2005/0260073 A1 * 11/2005 Hsu et al. ..... 415/199.6
2008/0317586 A1 * 12/2008 Kuma ..... 415/119
2009/0180870 A1 * 7/2009 Phlegm et al. ..... 415/208.2
2009/0246013 A1 * 10/2009 Kenyon et al. ..... 415/208.2

FOREIGN PATENT DOCUMENTS

JP 2003-328994 11/2003

* cited by examiner

*Primary Examiner* — George Fourson, III

(74) *Attorney, Agent, or Firm* — Nelson Mullins Riley & Scarborough LLP; Anthony A. Laurentano

(57) ABSTRACT

A centrifugal air blower guides returning air from a fan rotated by a rotational drive source out of interference with air delivered by a fan. The centrifugal air blower includes a rotational drive source having a rotational drive shaft, a housing including a holder which holds the rotational drive source in surrounding relation thereto, and a fan coupled to the rotational drive shaft of the rotational drive source. The housing has a disk-shaped flange extending from the holder, and the flange has a plurality of air guides disposed on a surface thereof and extending toward a peripheral edge of the flange.

18 Claims, 16 Drawing Sheets

CENTRIFUGAL AIR BLOWER

BACKGROUND OF THE INVENTION

1. Field of the Invention

The present invention relates to a centrifugal air blower, and more particularly to a centrifugal air blower for use in an air-conditioning unit mounted on vehicles.

2. Description of the Related Art

Heretofore, air-conditioning units for use on vehicles incorporate a centrifugal air blower including a fan for drawing in air from within the passenger compartment or from outside the passenger compartment and a motor for rotating the fan (see Japanese laid-open patent publication No. 2003-328994).

FIG. 16 of the accompanying drawings schematically shows in cross section a centrifugal air blower of the related art. As shown in FIG. 16, the centrifugal air blower, generally denoted by 100, comprises a rotational drive source 102, a fan 104 rotated by the rotational drive source 102, and a housing 106 including a holder 108 which holds the rotational drive source 102 in surrounding relation thereto.

The housing 106 has a coolant passage 110 defined therein for passing therethrough cooling air for cooling the rotational drive source 102. The coolant passage 110 has an opening 112 in one end thereof.

When the rotational drive source 102 is energized, it rotates the fan 104 to deliver air into the passenger compartment. If the rotational drive source 102 is continuously energized over a long period of time, then the rotational drive source 102 itself generates heat. To prevent the rotational drive source 102 from generating too much heat, part of the air flow generated by the fan 104 is guided through the opening 112 into the coolant passage 110 as indicated by the arrows and applied to the outer circumferential surface of the rotational drive source 102 to cool the rotational drive source 102.

However, the cooling air (returning air) which has cooled the rotational drive source 102 and the air delivered from the fan 104 tend to interfere with each other on the housing 106, producing a resonant sound. Furthermore, the returning air and the air delivered from the fan 104 interfere with air flowing through a bell mouth of a casing which houses the rotational drive source 102, the fan 104, and the housing 106, also producing a resonant sound.

SUMMARY OF THE INVENTION

It is an object of the present invention to provide a centrifugal air blower which guides returning air out of interference with air delivered by a fan, and the returning air and the air delivered by the fan are also prevented from interfering with air flowing through a bell mouth, for thereby reducing a resonant sound and providing a silent operating environment.

According to the present invention, a centrifugal air blower includes a rotational drive source having a rotational drive shaft, a housing including a holder which holds the rotational drive source in surrounding relation thereto, and a fan coupled to the rotational drive shaft of the rotational drive source, the housing having a disk-shaped flange extending from the holder, the flange having a plurality of air guides disposed on a surface thereof and extending toward a peripheral edge of the flange.

With the above arrangement, returning air from the fan is guided by the air guide so as to be out of interference with an air flow produced by the fan.

The housing should preferably have a tapered skirt extending from an upper portion of the holder toward the flange. The air guides should preferably be disposed near positions where the tapered skirt terminates. The holder should preferably have an upper portion joined to the air guides by slanted members. The tapered skirt and the slanted members are effective to deliver the returning air smoothly to the air guides.

Each of the air guides extends at a positive angle to the radial direction of the flange with respect to the direction in which the fan rotates, the positive angle ranging from 0 to 70 degrees, or preferably from 30 to 50 degrees. The angle makes it more effective to allow the air guides to guide the returning air.

Each of the air guides should preferably be curved with respect to the radial direction of the flange.

Each of the air guides should preferably be disposed at a position corresponding to an opening defined in a cover member covering the rotational drive source.

According to the present invention, the tapered skirt extends from the upper portion of the holder toward the flange, and the air guides are disposed near positions where the tapered skirt terminates. The returning air is thus guided out of interference with the air delivered by the fan, and the returning air and the air delivered by the fan are also prevented from interfering with air flowing through the bell mouth, for thereby effectively reducing a resonant sound which would otherwise be generated by the centrifugal air blower.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
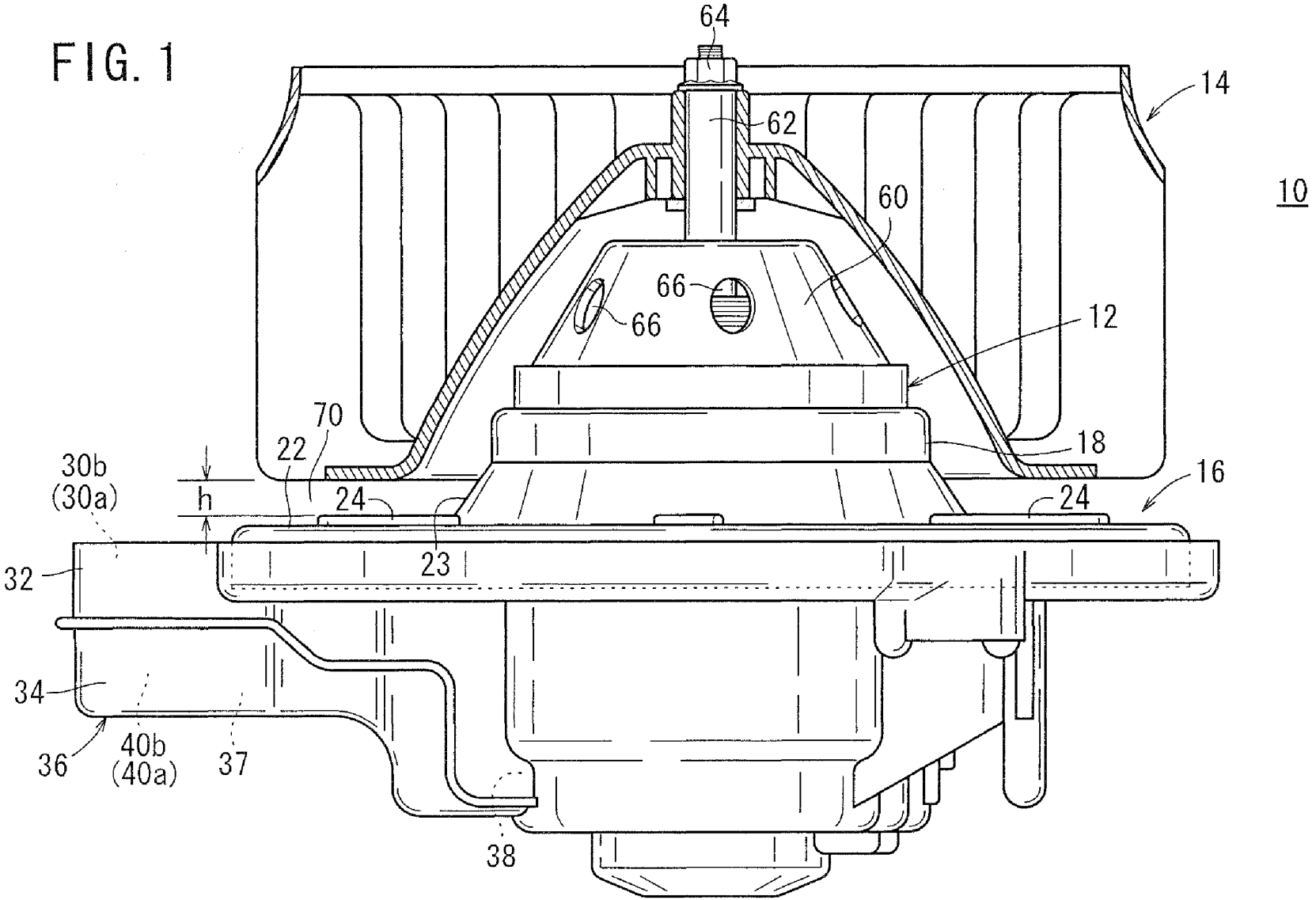
FIG. 1 is a front elevational view, partly in vertical cross-section, of a centrifugal air blower according to an embodiment of the present invention.
Figure 2:
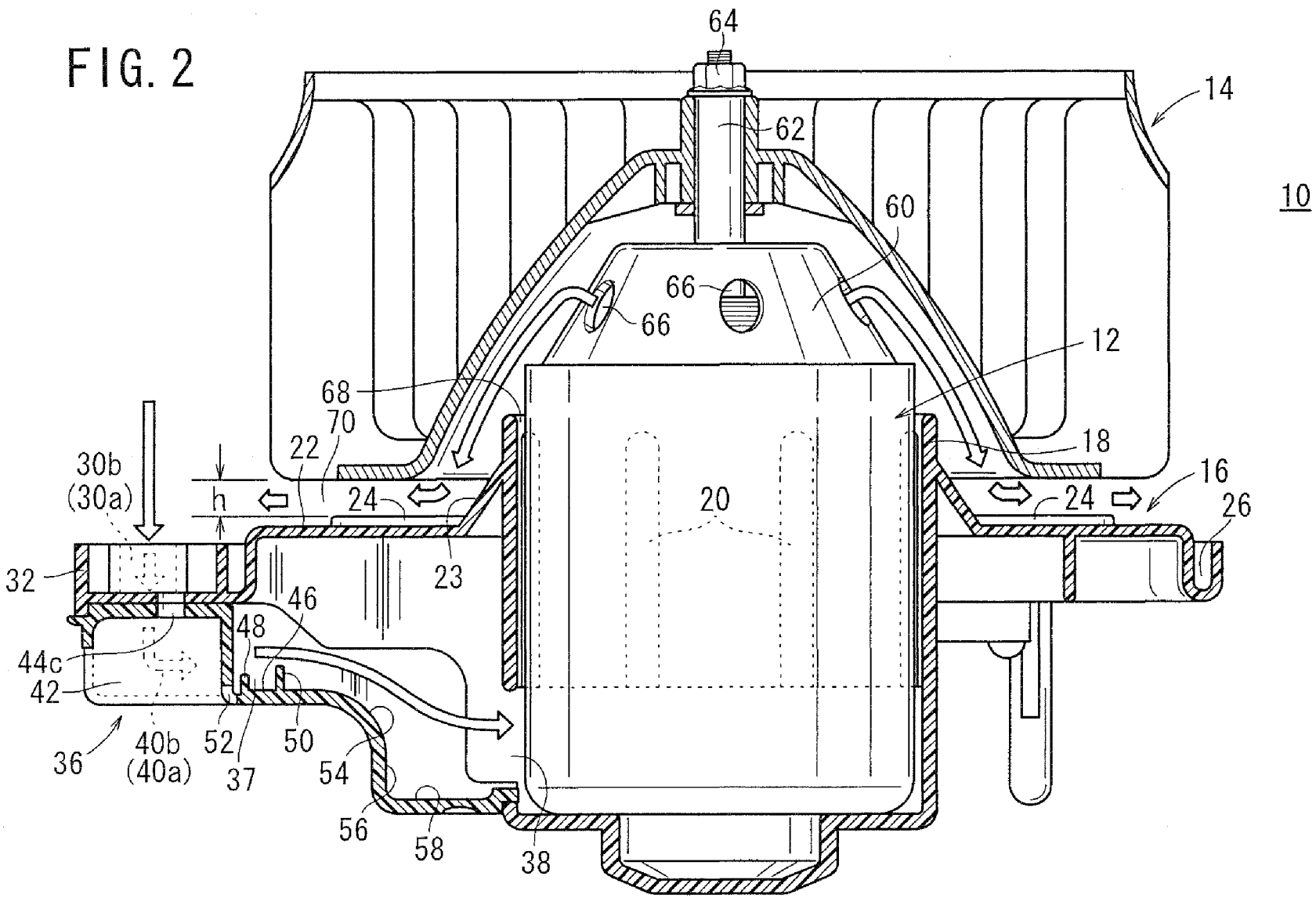
FIG. 2 is a vertical cross-sectional view, partly in front elevation, of a fan and a holder of the centrifugal air blower shown in FIG. 1.
Figure 3:
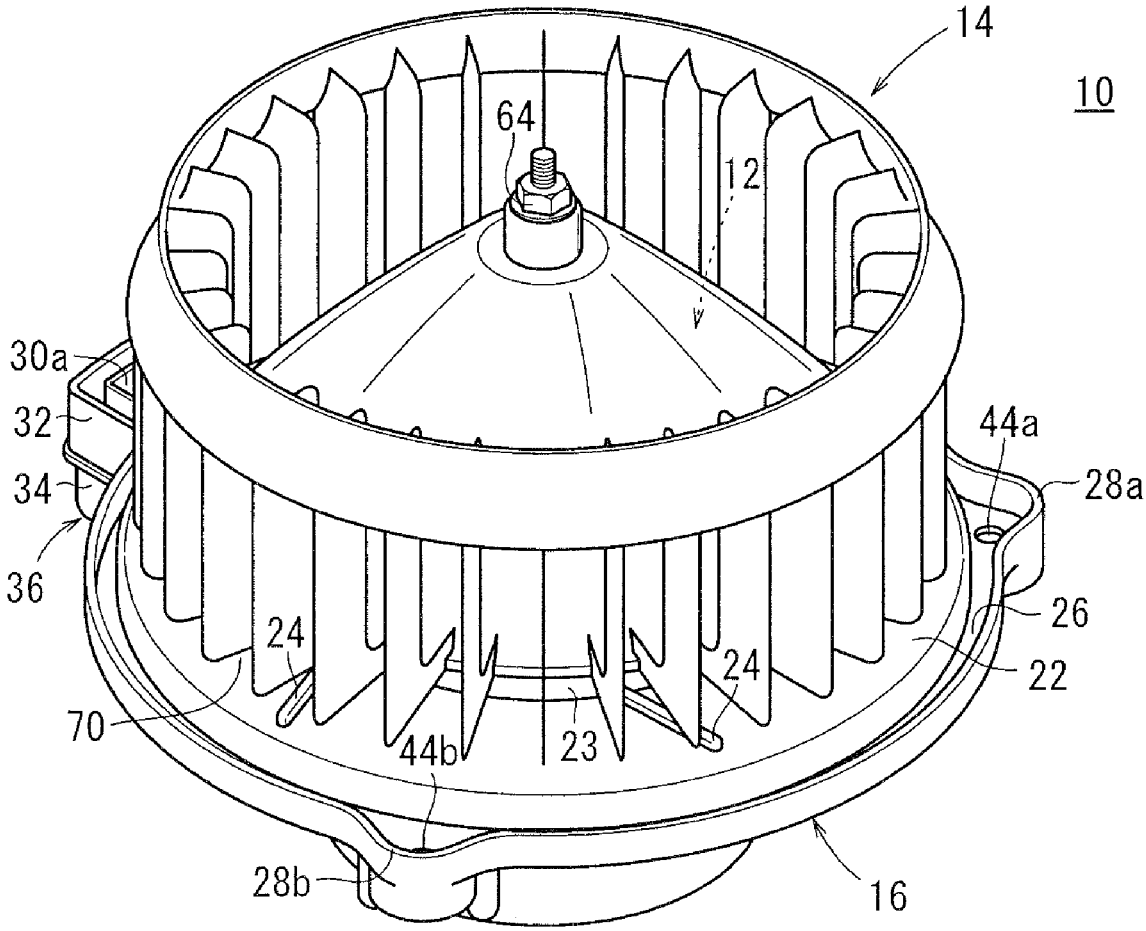
FIG. 3 a perspective view of the fan and the holder of the centrifugal air blower.
Figure 4:
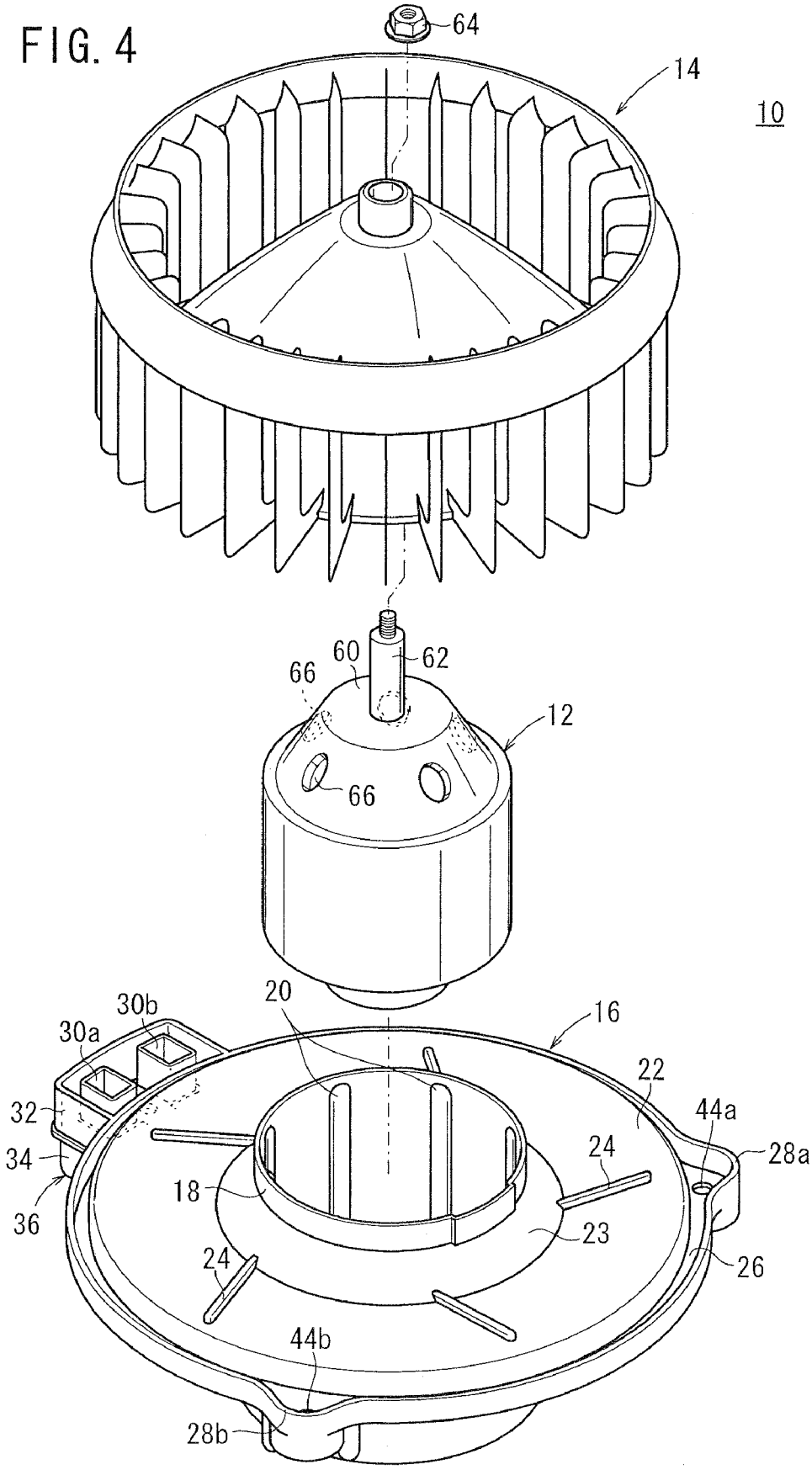
FIG. 4 is an exploded perspective view of the centrifugal air blower.
Figure 5:
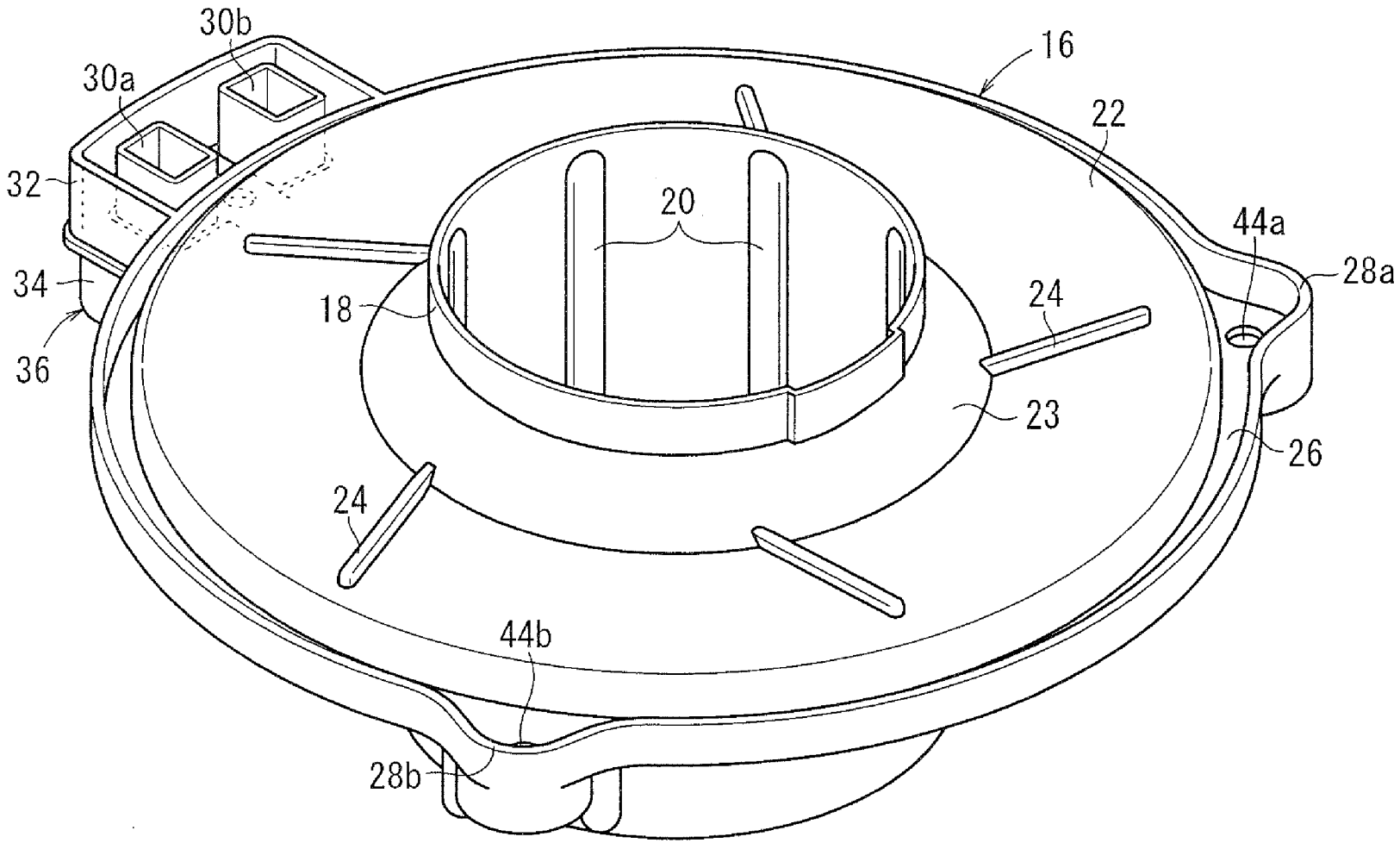
FIG. 5 is a perspective view of a housing of the centrifugal air blower.

Centrifugal air blowers according to preferred embodiments of the present invention, for use in an air-conditioning unit mounted on a vehicle, will be described in detail below with reference to the accompanying drawings. FIG. 1 is a front elevational view, partly in vertical cross-section, of a centrifugal air blower 10 according to an embodiment of the present invention, FIG. 2 is a vertical cross-sectional view, partly in front elevation, of a fan and a holder of the centrifugal air blower 10 shown in FIG. 1, FIG. 3 a perspective view of the fan and the holder of the centrifugal air blower 10, and FIG. 4 is an exploded perspective view of the centrifugal air blower 10.

The centrifugal air blower 10 comprises a rotational drive source 12 such as a motor or the like, a fan 14 rotated by the rotational drive source 12, and a housing 16 including a hollow cylindrical holder 18 which holds the rotational drive source 12 in surrounding relation thereto.

Figure 6:
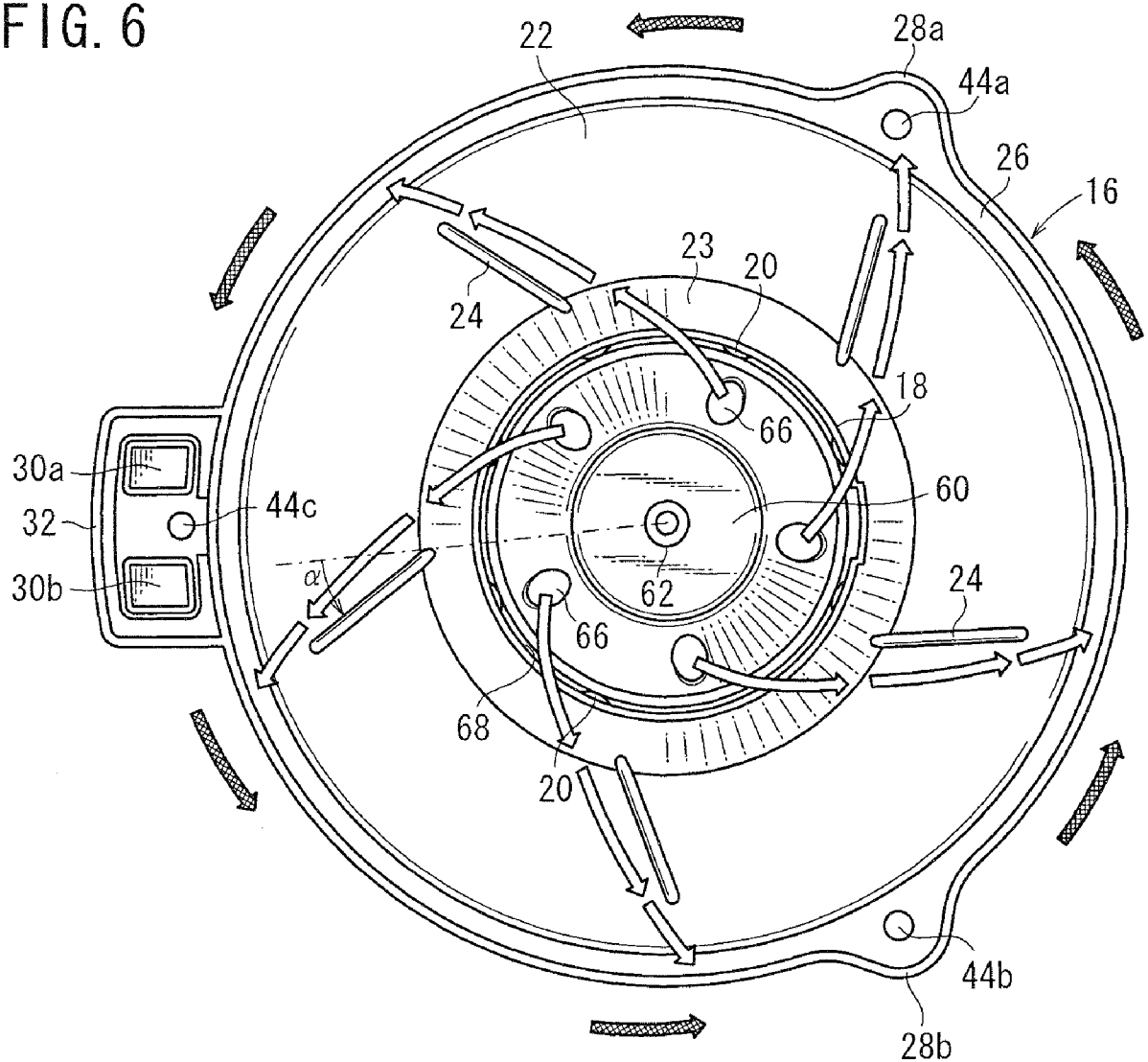
FIG. 6 is a plan view of the housing of the centrifugal air blower.

The holder 18 has a plurality of axial ribs 20 projecting radially inwardly from an inner circumferential wall surface thereof and spaced at equal circumferential intervals, providing a clearance between the rotational drive source 12 and the holder 18. As shown in FIGS. 2 and 4, the housing 16 has a tapered skirt 23 projecting from an upper portion of an outer circumferential wall surface of the holder 18 and a horizontal disk-shaped flange 22 extending radially outwardly from a lower outer end of the tapered skirt 23. The flange 22 has a plurality of rod-shaped air guides 24 spaced at equal circumferential intervals and extending outwardly from the lower outer end of the tapered skirt 23 at a certain positive angle to the radial direction of the flange 22 with respect to the direction in which the fan 14 rotates. Specifically, each of the air guides 24 is inclined an angle $\alpha$ to the radial direction of the flange 22 with respect to the direction indicated by the hatched arrows in FIG. 6. In FIG. 6, the flange 22 is shown as having five air guides 24. However, the flange 22 is not limited to having five air guides 24, but may have as many air guides 24 as the number of air discharge holes 66 defined in a cover member 60 to be described later, so that each of the air guides 24 is associated with one of the air discharge holes 66. The air guides 24 may be determined depending on the positions of the air discharge holes 66 for best air guiding effects.

The flange 22 has a circular trough 26 defined along an outer circumferential edge thereof and including an outer circumferential wall partly projecting outwardly into two tongues 28*a*, 28*b* which are circumferentially spaced from each other. The tongues 28*a*, 28*b* have respective holes 44*a*, 44*b* defined in their bottoms. Bolts, not shown, are inserted through the holes 44*a*, 44*b* and nuts, not shown, are threaded over the bolts to fasten the housing 16 to a base, not shown.

A rectangular wing 32 also projects radially outwardly from the outer circumferential wall of the trough 26. The rectangular wing 32 includes two cooling air inlet holes 30*a*, 30*b* defined therein, each having a rectangular shape as viewed in plan. The rectangular wing 32 has a lower end closed by a lid 34. The rectangular wing 32 and the lid 34 jointly define a coolant passage 36 whose inner space serves as a fluid reservoir 37 (see FIGS. 7 and 8). The fluid reservoir 37 guides cooling air to flow through an opening 38 defined in a lower side wall of the holder 18 to the circumferential wall of the rotational drive source 12 to cool the same.

Figure 7:
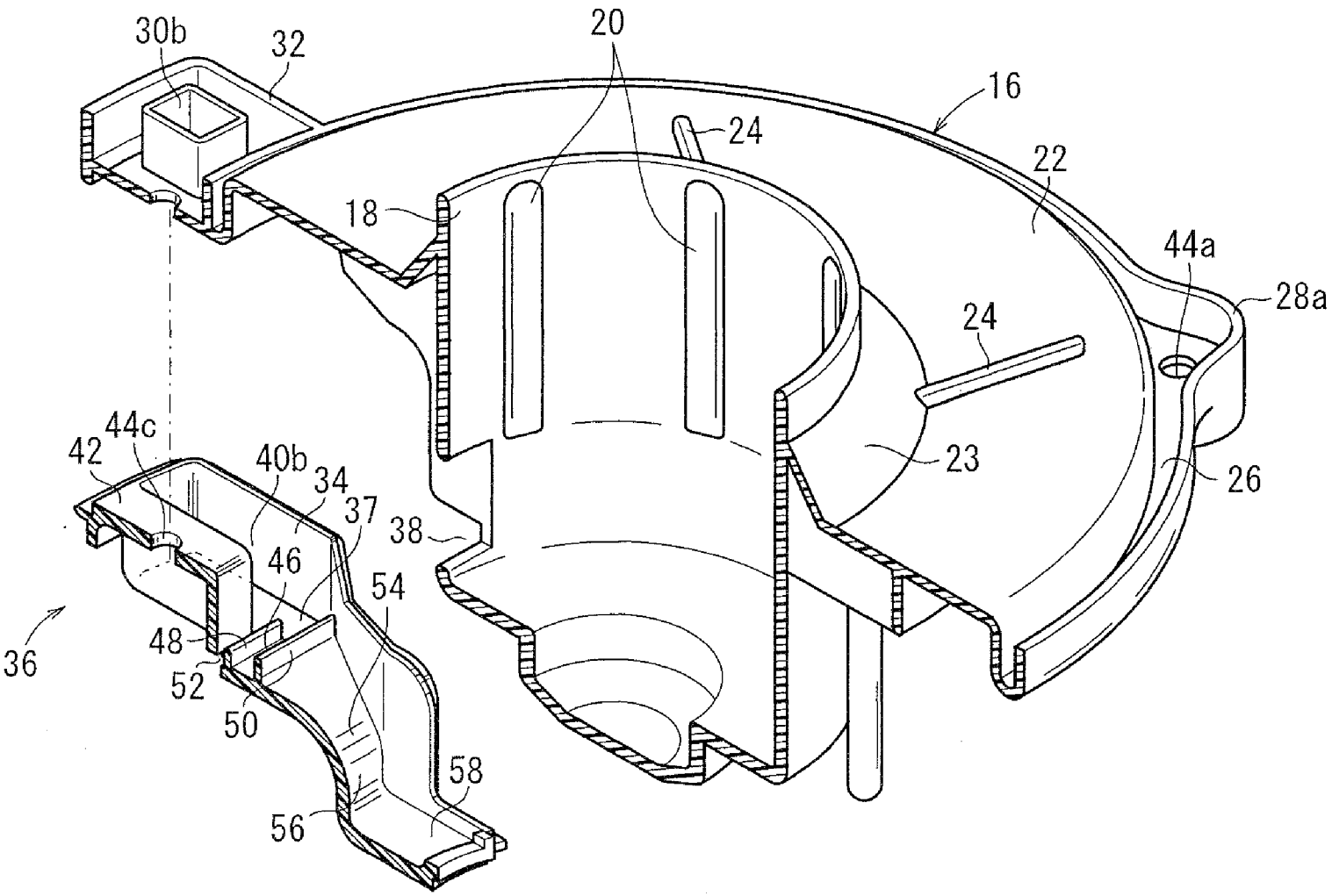
FIG. 7 is an exploded perspective view, partly in cross section, of the housing of the centrifugal air blower.
Figure 8:
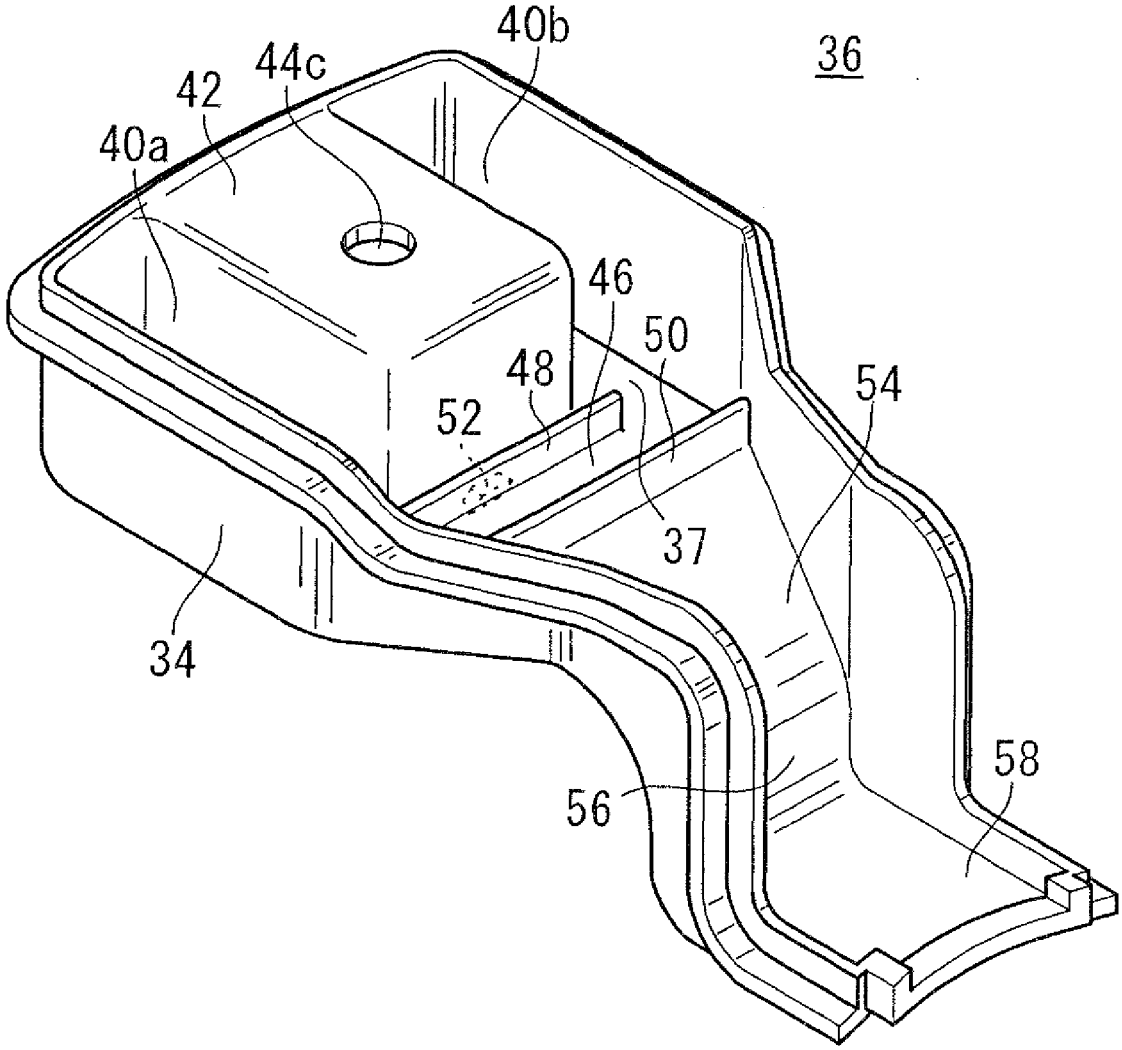
FIG. 8 is a perspective view of a coolant passage of the centrifugal air blower.
Figure 9:
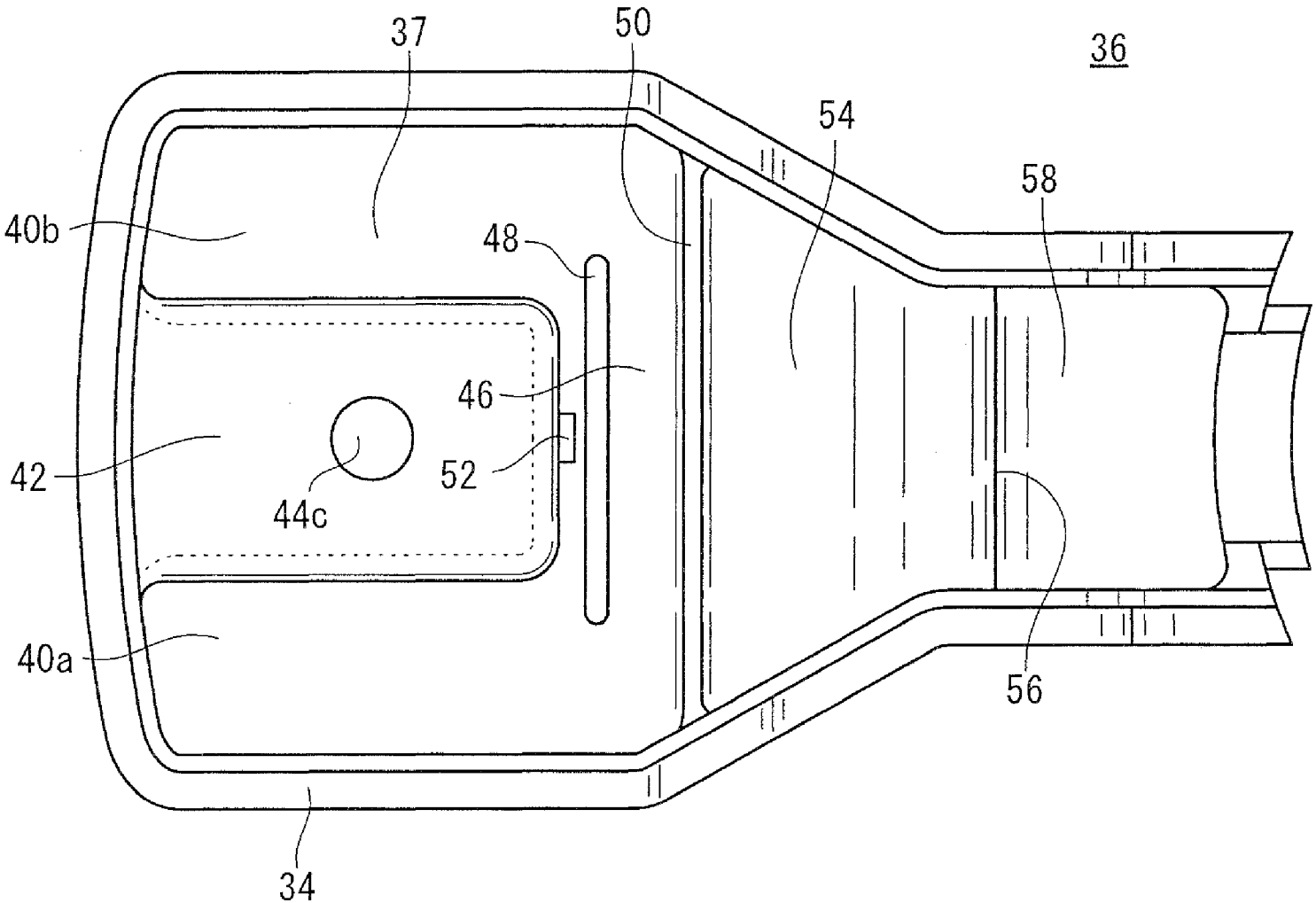
FIG. 9 is a plan view of the coolant passage of the centrifugal air blower.

Structural details for supplying the cooling air to the rotational drive source 12 will be described in detail below. As shown in FIGS. 7 through 9, the lid 34 has passage cavities 40*a*, 40*b* disposed in alignment with the respective cooling air inlet holes 30*a*, 30*b* and a rectangular land 42 disposed between the passage cavities 40*a*, 40*b*. The fluid reservoir 37 is partly defined by the passage cavities 40*a*, 40*b*. The land 42 has a hole 44*c* defined centrally in its upper surface. A bolt, not shown, is inserted through the hole 44*c* and a nut, not shown, is threaded over the bolt to fasten the housing 16 to the base, in combination with the bolts inserted through the holes 44*a*, 44*b*.

The fluid reservoir 37 has a horizontal first bottom surface 46 including a rib 48 erected thereon near a terminating end of the land 42 and another rib 50 erected thereon which extends parallel to the rib 48. As can be seen from FIG. 2, the rib 50 (hereinafter referred to as "first rib") is higher than the rib 48 (hereinafter referred to as "second rib").

The fluid reservoir 37 has a drain hole 52 defined in the first bottom surface 46 upstream of and near the lower end of the second rib 48. The drain hole 52 serves to discharge a fluid out of the fluid reservoir 37.

The first bottom surface 46 of the fluid reservoir 37 has a terminal end joined to a slanted surface 54 which extends obliquely downwardly from the lower end of the first rib 50. The slanted surface 54 has a terminal end joined to a vertical surface 56 whose terminal end is connected to a second bottom surface 58 that extends horizontally.

As shown in FIGS. 1 and 2, the rotational drive source 12 includes a conical cover 60 in its upper portion and has a vertical rotational drive shaft 62 projecting centrally through the conical cover 60. The fan 14 has a central hub fitted over the projecting end of the rotational drive shaft 62 and fastened thereto by a nut 64. The fan 14 itself is of known nature and will not be described in detail below. The cover 60 has a plurality of air discharge holes 66 defined in a tapered side wall thereof for discharging cooling air which has cooled the rotational drive source 12.

The centrifugal air blower 10 according to the present embodiment of the present invention is basically constructed as described above. Operation and advantages of the centrifugal air blower 10 will be described below. When the rotational drive source 12 is energized, the fan 14 is rotated to draw air in from within the passenger compartment or from outside the passenger compartment. Part of the air thus drawn is used as cooling air for cooling the rotational drive source 12. The cooling air is introduced from the cooling air inlet hole 30*a* and flows through the passage cavity 40*a* and the coolant passage 36, and also is introduced from the cooling air inlet hole 30*b* and flows through the passage cavity 40*b* and the coolant passage 36.

The cooling air that has flowed through the coolant passage 36 is introduced through the opening 38 into the holder 18, then flows through a clearance 68 between the rotational drive source 12 and the holder 18, and also flows through the rotational drive source 12, after which the cooling air is discharged from the air discharge holes 66 (see FIG. 2). The cooling air discharged as returning air from the air discharge holes 66 flows down the cover 60 and the tapered skirt 23. Since the tapered skirt 23 is slanted downwardly from the holder 18 toward the upper surface of the flange 22, the returning air moves smoothly along the flange 22. The returning air that has reached the flange 22, as indicated by the outline arrows in FIG. 6, is guided by the air guides 24 and joins the cooling air delivered from the fan 14 which is indicated by the hatched arrows in FIG. 6.

Since the returning air is guided by the air guides 24, the returning air is prevented from being disturbed into swirls on the surface of the flange 22. As a result, the returning air is less liable to interfere with the cooling air delivered from the fan 14, and hence a resonant sound which would otherwise be generated due to interference between the returning air and the cooling air is reduced.

As described above, the air guides 24 extend outwardly at the angle α to the radial direction of the flange 22. Since the returning air is guided by the air guides 24 and flows into the cooling air at the angle α, the returning air smoothly joins the cooling air, reducing any resonant sound which would otherwise be produced by the interference between the returning air and the cooling air.

Figure 10:
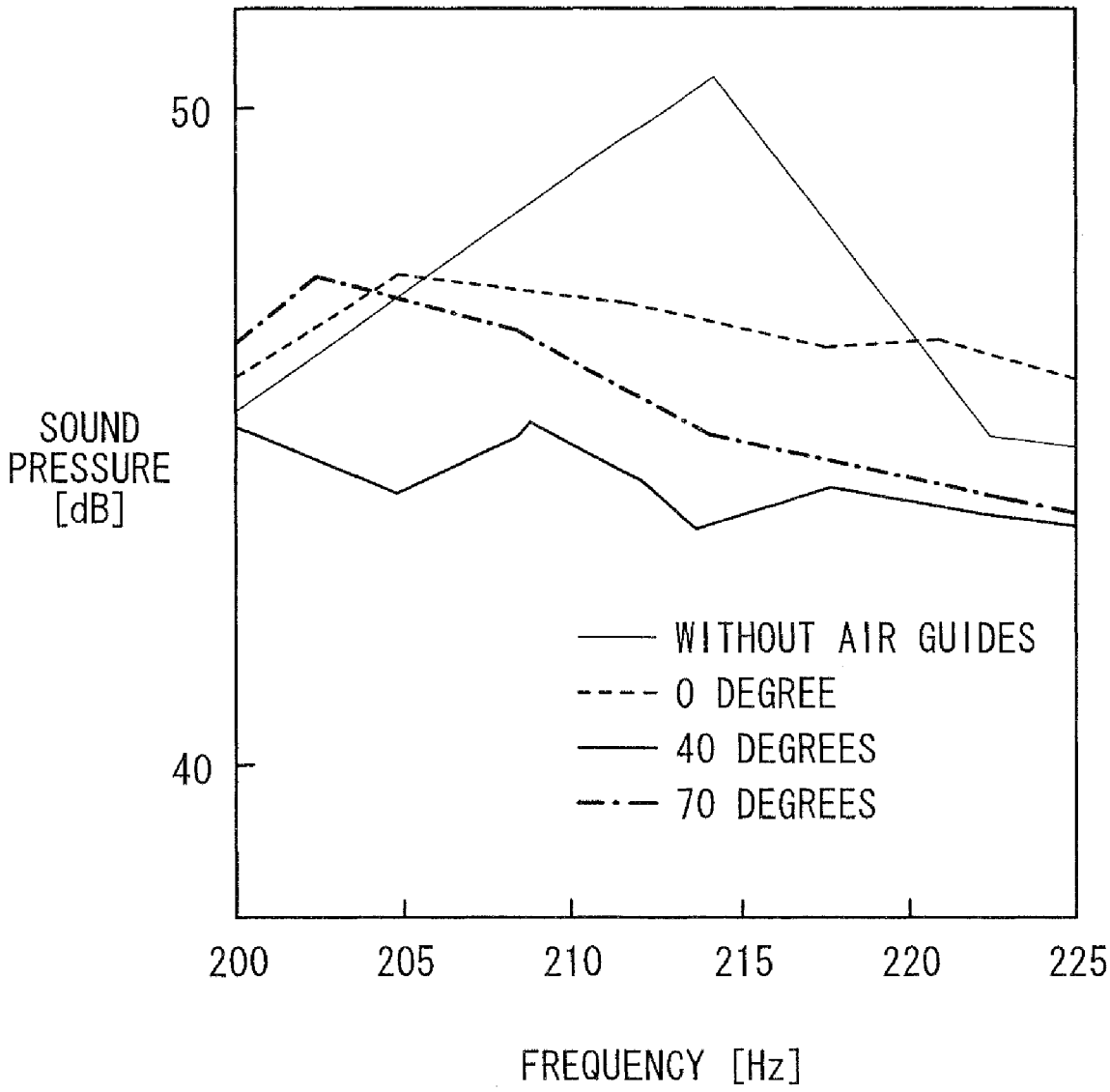
FIG. 10 is a diagram illustrative of how a resonant sound is reduced when the angle $\alpha$ of an air guide is varied.

FIG. 10 is a diagram showing the relationship between the angle α of the air guides 24 and the resonant sound, the diagram representing a graph having a horizontal axis indicative of the frequency of the resonant sound and a vertical axis of the sound pressure level of the resonant sound. The illustrated data include measured resonant sound data plotted when the flange 22 had no air guides 24, the flange 22 had the air guides 24 at an angle α of 0 degree, the flange 22 had the air guides 24 at an angle α of 40 degrees, and the flange 22 had the air guides 24 at an angle α of 70 degrees. It can be seen from FIG. 10 that the sound pressure of the resonant sound is lower when the flange 22 had the air guides 24 than when the flange 22 had no air guides 24 in the range of angles α from 0 to 70 degrees. In particular, the air guides 24 provide an outstanding resonant sound reducing effect near a resonant sound frequency of 215 Hz where the sound pressure of the resonant sound is of a peak value. The air guides 24 at the angles α of 0 and 70 degrees provide essentially the same resonant sound reducing effect. The air guides 24 at an angle α of about 40 degrees, i.e., in the range from 30 to 50 degrees are effective to reduce the resonant sound, and the air guides 24 at an angle α of 40 degrees are most effective to reduce the resonant sound.

When the angle α is 0 degree, the air guides 24 extend exactly in the radial direction of the flange 22. In this case, the angle α becomes independent of the direction in which the rotational drive source 12 rotates. Therefore, the air guides 24 can be disposed on the flange 22 without concern over the direction in which the rotational drive source 12 rotates. It is thus possible to reduce the cost of the housing 16 as a common die can be used to manufacture housings 16.

Figure 11:
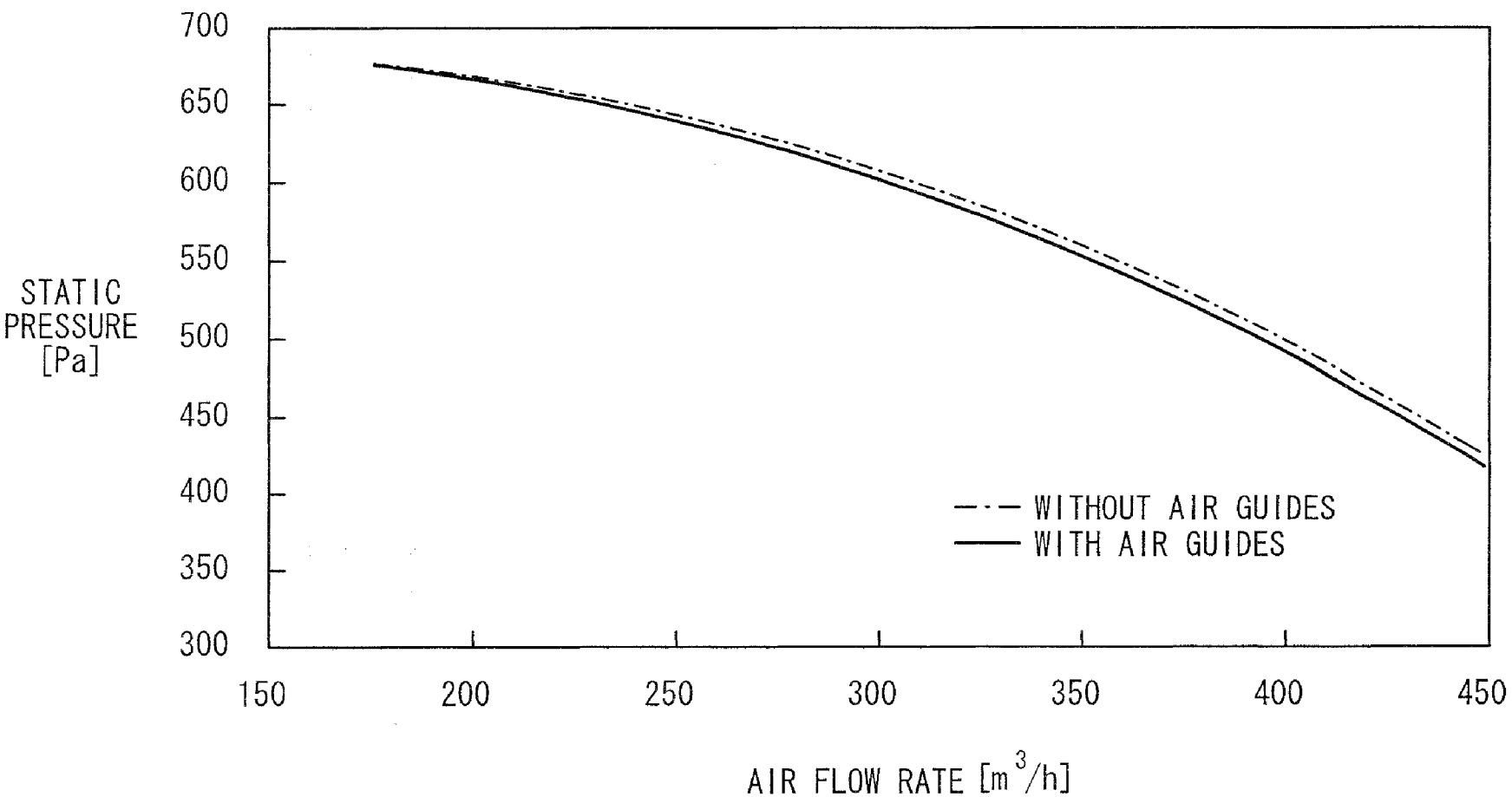
FIG. 11 is a diagram showing performance curves of the centrifugal air blower.

FIG. 11 is a diagram showing for comparison the performance curves of a centrifugal air blower 100 according to the related art and the centrifugal air blower 10 according to the present embodiment. The performance curve is used to evaluate the performance of an air blower based on the relation of static pressures to air flow rates. As can be seen from FIG. 11, the performance curves of the centrifugal air blowers 100, 10 are essentially the same as each other. Accordingly, the centrifugal air blower 10 according to the present embodiment is capable of reducing the resonant sound without causing a reduction in the air blower performance even though the air guides 24 are additionally incorporated in the centrifugal air blower 100.

Figure 12:
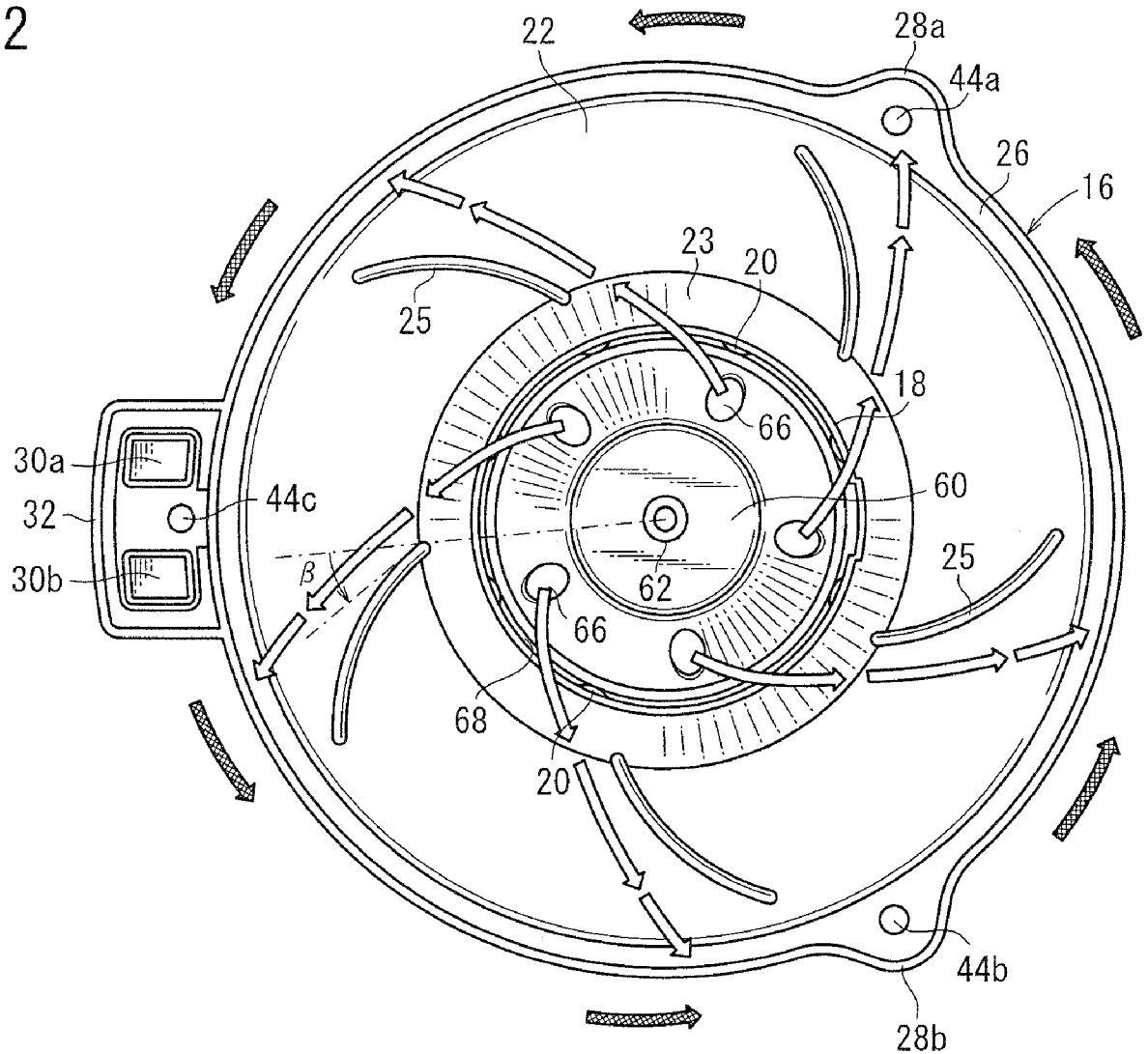
FIG. 12 is a plan view of modified air guides for use in the centrifugal air blower.

FIG. 12 is a plan view of a modification of the air guides 24 according to the present embodiment. According to the modification, air guides 25 which are curved with respect to the radial direction of the flange 22 are employed instead of the air guides 24. An angle β formed between the radial direction of the flange 22 and a line tangential to the air guides 25 is defined as the above angle α for effectively reducing the resonant sound.

Figure 13A:
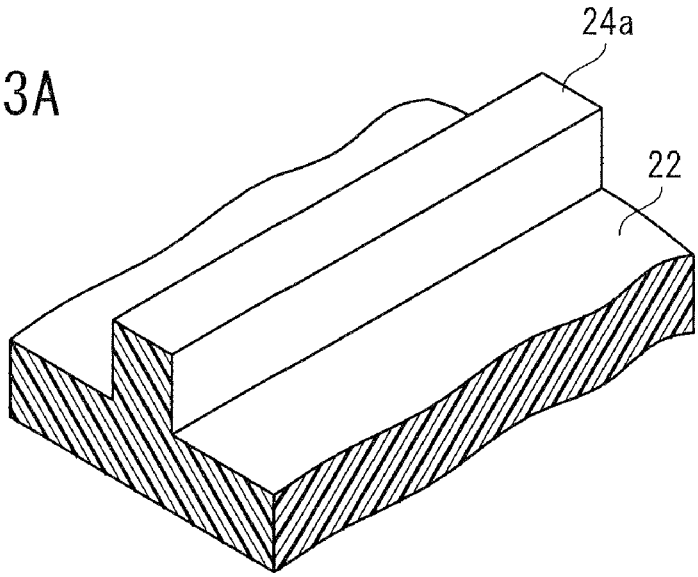
FIGS. 13A through 13C are enlarged fragmentary perspective views of other modified air guides for use in the centrifugal air blower.
Figure 13B:
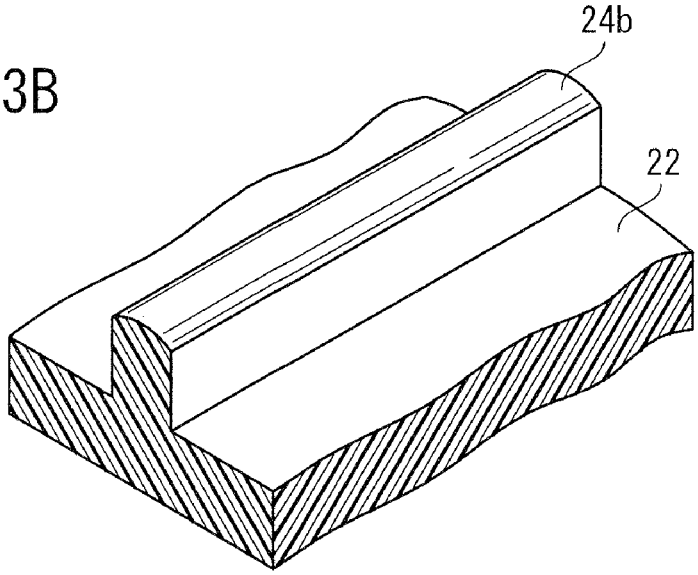
Figure 13C:
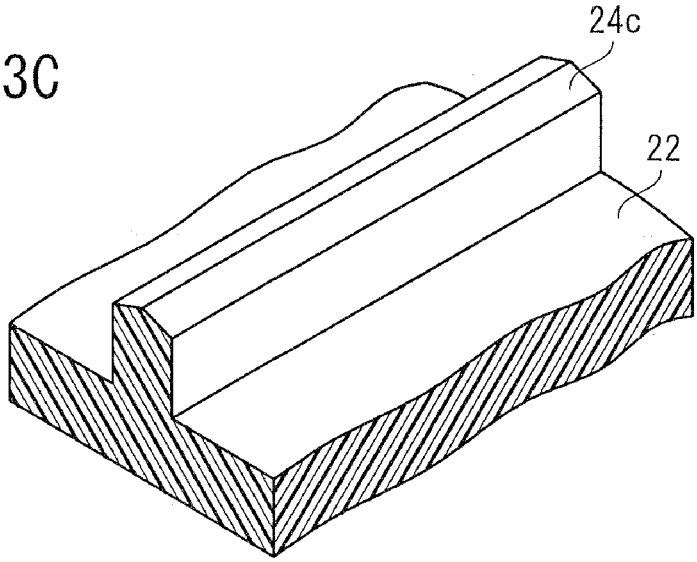

FIGS. 13A through 13B show other modifications of the air guides 24 according to the present embodiment. The air guides 24 on the flange 22 are not limited to any particular cross-sectional shapes. FIG. 13A shows an air guide 24*a* is of a cross-sectional shape having a flat upper surface. FIG. 13B shows an air guide 24*b* is of a cross-sectional shape having an upwardly convex curved upper surface. FIG. 13C shows an air guide 24*c* is of a cross-sectional shape having an upwardly projecting triangular upper surface.

If a liquid is applied to the upper surfaces of these air guides 24*a* through 24*c*, then the applied liquid may not fall off, but remain on, the air guide 24*a*, and may be liable to fall off the air guides 24*b*, 24*c*. Therefore, the air guides 24*b*, 24*c* are preferable to the air guide 24*a*.

In view of the surface tension of water applied to the upper surface of the air guide 24*a*, if a gap 70 (see FIG. 2) between the lower surface of the fan 14 and the upper surface of the air guide 24*a* has a height h of 5.5 mm, then the air guide 24*a* should preferably have a height of 2 mm and a width of 2 mm. The air guide 24*a* thus constructed is effective to prevent the water applied to the upper surface thereof from contacting the lower surface of the fan 14, and is also effective to prevent the applied water, which may be frozen at low temperatures, from causing the fan 14 and the flange 22 to stick to each other.

Figure 14:
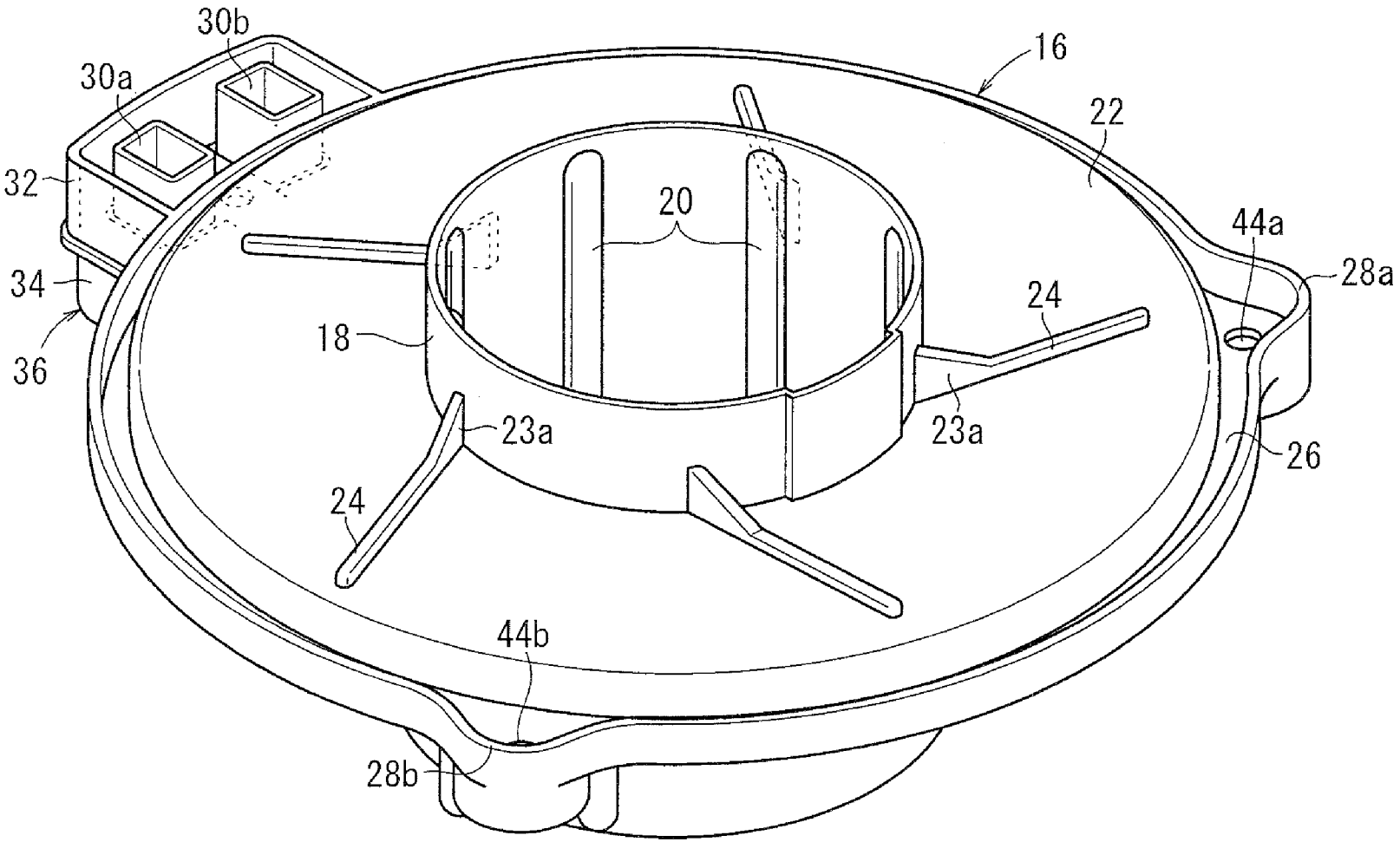
FIG. 14 is a perspective view showing slanted members incorporated in the centrifugal air blower.

FIG. 14 is a perspective view showing a modification of the tapered skirt 23 of the holder 18 according to the above embodiment. As shown in FIG. 14, the upper portion of the holder 18 and the air guides 24 are joined to each other by slanted members 23*a* having slanted surfaces inclined to the flange 22.

Figure 15:
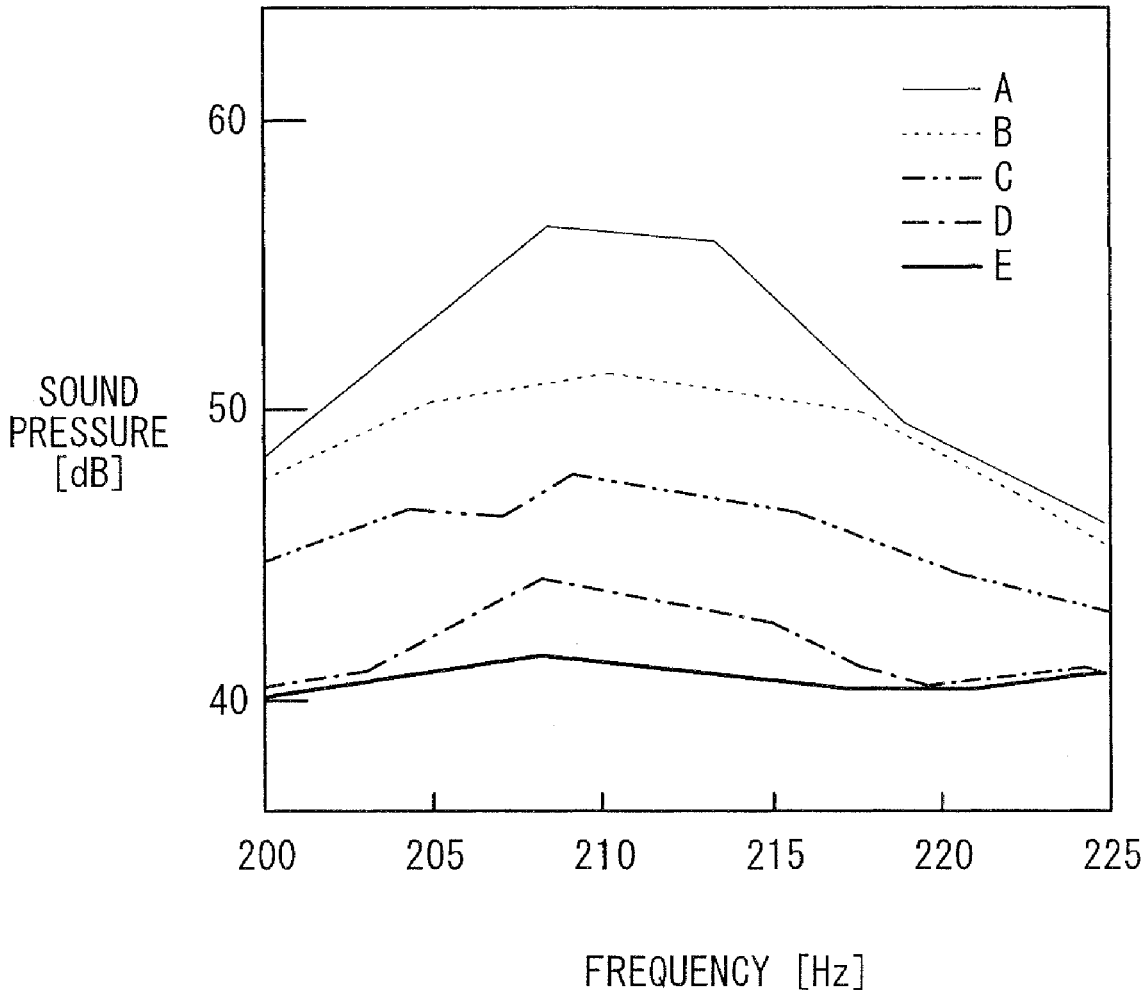
FIG. 15 is a diagram illustrative of how different resonant sound reducing effects are achieved by the centrifugal air blower.
Figure 16:
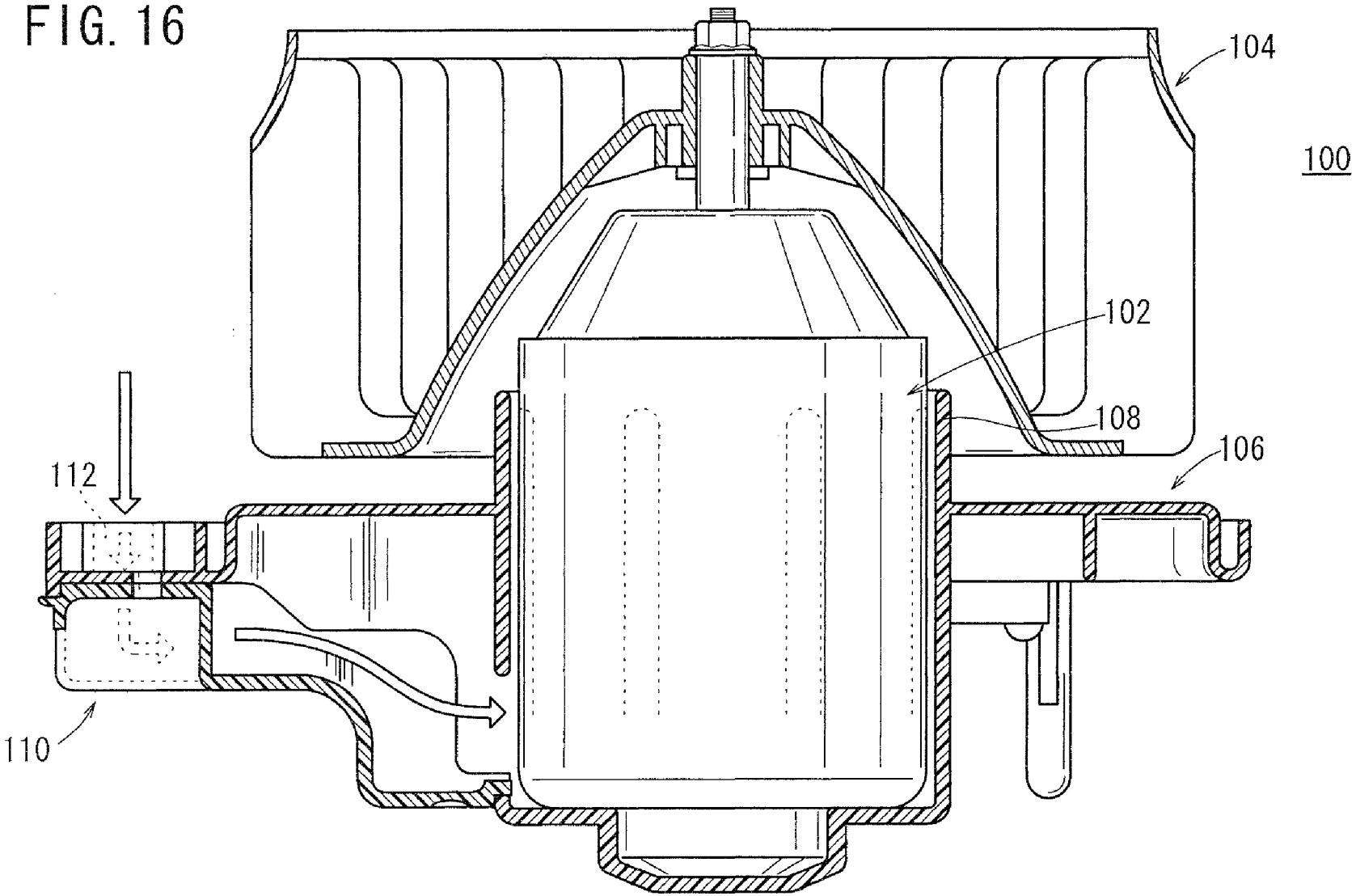
FIG. 16 is a vertical cross-sectional view, partly in front elevation, of a centrifugal air blower according to the related art.

FIG. 15 is a diagram showing for comparison the resonant sound reducing effects of the centrifugal air blower 100 according to the related art and the centrifugal air blower 10 according to the present embodiment, the diagram representing a graph having a horizontal axis indicative of the frequency of the resonant sound and a vertical axis of the sound pressure level of the resonant sound. The illustrated data include measured resonant sound data A plotted from the centrifugal air blower 100, measured resonant sound data B plotted when the centrifugal air blower 10 had no tapered skirt 23 on the holder 18, had the air guides 24 on the flange 22, and the angle α was of a negative value, measured resonant sound data C plotted when the centrifugal air blower 10 had no tapered skirt 23 on the holder 18, had the air guides 24 on the flange 22, and the angle α was of a positive value of 70 degrees, measured resonant sound data D plotted when the centrifugal air blower 10 had the tapered skirt 23 on the holder 18, had the air guides 24 on the flange 22, and the angle α was of a positive value of 70 degrees, and measured resonant sound data E plotted when the centrifugal air blower 10 had the tapered skirt 23 on the holder 18, had the air guides 24 on the flange 22, and the angle α was of a positive value of 40 degrees. It can be seen from FIG. 15 that the tapered skirt 23 and the air guides 24 are effective to reduce the resonant sound. It can be understood that the centrifugal air blower 10 which has the tapered skirt 23 on the holder 18 and the air guides 24 on the flange 22 with the angle α being of 40 degrees is most effective to reduce the resonant sound.

As described above, the centrifugal air blower 10 according to the present invention has the tapered skirt 23 extending from the upper portion of the holder 18 to the flange 22 and the air guides 24 extending from the terminating end or lower outer end of the tapered skirt 23, for guiding the returning air to minimize the interference between the returning air and the cooling air delivered from the fan 14, and also to reduce the interference between the returning air and the cooling air and air flowing through the bell mouth for thereby effectively reducing any resonant sound.

Although certain preferred embodiments of the present invention have been shown and described in detail, it should be understood that various changes and modifications may be made therein without departing from the scope of the appended claims.

What is claimed is:

1. A centrifugal air blower comprising:

a rotational drive source having a rotational drive shaft;

a housing including a holder which holds said rotational drive source in surrounding relation thereto; and a fan coupled to said rotational drive shaft of the rotational drive source;

said housing having a disk-shaped flange extending from said holder;

said flange having a plurality of air guides disposed on a surface thereof and extending toward a peripheral edge of the flange.

2. A centrifugal air blower according to claim 1, wherein said housing has a tapered skirt extending from an upper portion of said holder toward said flange, said air guides being disposed near positions where said tapered skirt terminates.

3. A centrifugal air blower according to claim 1, wherein said housing has slanted members joining an upper portion of said holder to said air guides.

4. A centrifugal air blower according to claim 1, wherein each of said air guides extends at a positive angle to the radial direction of said flange with respect to the direction in which said fan rotates, said positive angle ranging from 0 to 70 degrees.

5. A centrifugal air blower according to claim 2, wherein each of said air guides extends at a positive angle to the radial direction of said flange with respect to the direction in which said fan rotates, said positive angle ranging from 0 to 70 degrees.

6. A centrifugal air blower according to claim 3, wherein each of said air guides extends at a positive angle to the radial direction of said flange with respect to the direction in which said fan rotates, said positive angle ranging from 0 to 70 degrees.

7. A centrifugal air blower according to claim 1, wherein each of said air guides is curved with respect to the radial direction of said flange.

8. A centrifugal air blower according to claim 2, wherein each of said air guides is curved with respect to the radial direction of said flange.

9. A centrifugal air blower according to claim 3, wherein each of said air guides is curved with respect to the radial direction of said flange.

10. A centrifugal air blower according to claim 4, wherein each of said air guides is curved with respect to the radial direction of said flange.

11. A centrifugal air blower according to claim 5, wherein each of said air guides is curved with respect to the radial direction of said flange.

12. A centrifugal air blower according to claim 6, wherein each of said air guides is curved with respect to the radial direction of said flange.

13. A centrifugal air blower according to claim 1, wherein each of said air guides is disposed at a position corresponding to an opening defined in a cover member covering said rotational drive source.

14. A centrifugal air blower according to claim 2, wherein each of said air guides is disposed at a position corresponding to an opening defined in a cover member covering said rotational drive source.

15. A centrifugal air blower according to claim 3, wherein each of said air guides is disposed at a position corresponding to an opening defined in a cover member covering said rotational drive source.

16. A centrifugal air blower according to claim 4, wherein each of said air guides is disposed at a position corresponding to an opening defined in a cover member covering said rotational drive source.

17. A centrifugal air blower according to claim 5, wherein each of said air guides is disposed at a position corresponding to an opening defined in a cover member covering said rotational drive source.

18. A centrifugal air blower according to claim 6, wherein each of said air guides is disposed at a position corresponding to an opening defined in a cover member covering said rotational drive source.

* * * * *